United States Patent [19]

Herzfeld

[11] 4,272,939

[45] Jun. 16, 1981

[54] JOINTING CONSTRUCTION

[75] Inventor: Michael O. H. Herzfeld, Osborne Park, Australia

[73] Assignee: Producer Manufacturers Pty. Ltd., Osborne Park, Australia

[21] Appl. No.: 967,354

[22] Filed: Dec. 7, 1978

[30] Foreign Application Priority Data

Dec. 7, 1977 [AU] Australia ..... PD2697

[51] Int. Cl.[3] ..... E04D 1/00

[52] U.S. Cl. ..... 52/527; 52/309.9; 52/406; 52/416; 52/540

[58] Field of Search ..... 52/309.9, 406, 527, 52/394, 523, 525, 416, 417, 419, 420, 409, 518, 526, 540

[56] References Cited

U.S. PATENT DOCUMENTS

| | | | |
|---|---|---|---|
| 1,356,930 | 10/1920 | McCord, Jr. | 52/394 X |
| 2,241,058 | 5/1941 | Eason | 52/420 X |
| 2,264,976 | 12/1941 | Heritage | 52/406 |
| 2,335,220 | 11/1943 | Edwards | 52/406 X |
| 3,111,787 | 11/1963 | Chamberlain | 52/409 X |
| 3,307,306 | 3/1967 | Oliver | 52/409 X |
| 3,468,086 | 9/1969 | Warner | 52/540 X |
| 3,505,770 | 4/1970 | Bennett | 52/540 X |
| 3,874,983 | 4/1975 | Hay et al. | 52/309.9 X |

*Primary Examiner*—Price C. Faw, Jr.
*Assistant Examiner*—Carl D. Friedman
*Attorney, Agent, or Firm*—Harness, Dickey & Pierce

[57] ABSTRACT

A jointing construction for laminated panels of the type having a core lamination of heat insulating material and facing sheet laminations bonded to opposed sides of the core, the jointing construction being characterized in that each panel is formed such that at least one side edge portion of one facing sheet extends beyond the core lamination to define a projection, the or each opposed side edge portion of said facing sheet having an engaging member associated therewith a pair of said panels in use being intended to be disposed adjacent each other such that the projection of one panel is engaged by the engaging member of the other panel, and sealing means being provided between said projection of one panel and the adjacent side edge portion of the corresponding facing sheet of the other panel.

6 Claims, 1 Drawing Figure

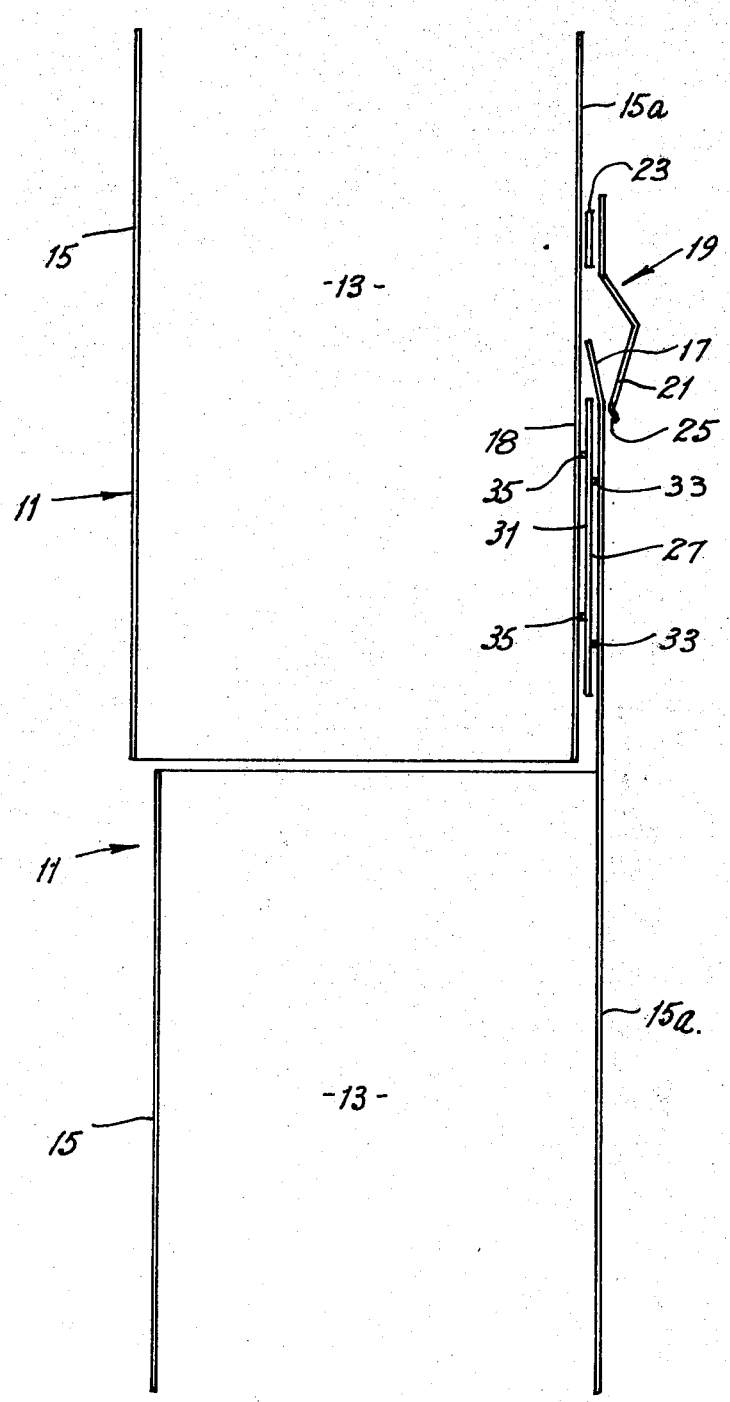
15a
23
19
15
-13-
17
21
25
18
35
33
11
31
27
35
33
11
15a.
-13-
15

JOINTING CONSTRUCTION

This invention relates to jointing of laminated panels of the type having a core of heat insulating material and facing sheets bonded to opposed sides of the core.

Conventional jointing of laminated panels of the type having a core of heat insulating material and facing sheets bonded to opposed sides of the core generally consists of an extrusion of suitable cross-sectional shape engaged between a pair of adjacent panels with a seal formed from non-skinning mastic applied between the extrusion and each panel. The non-skinning mastic is able to provide an effective barrier against moisture laden vapour but is unable to permanently resist penetration by water in situations where water is in contact with the joint for any length of time. Thus in a building construction, such conventional jointing may be satisfactory between panels forming the walls of the building, however, a roof formed by the panels would be required to be protected by a weather shield or separate waterproof roof, so as to prevent water collecting on the roof formed by the panels and subsequently penetrating the conventional joints.

It is an object of this invention to provide a water proof jointing for panels of the type having a core of heat insulating material and facing sheets bonded to opposed sides of the core.

In one form the invention resides in a jointing construction for laminated panels of the type having a core lamination of heat insulating material and facing sheet laminations bonded to opposed sides of the core, the jointing construction being characterised in that each panel is formed such that at least one side edge portion of one facing sheet extends beyond the core lamination to define a projection, the (or each) opposed side edge portion of said facing sheet having an engaging member associated therewith, a pair of said panels in use being intended to be disposed adjacent each other such that the projection of one panel is engaged by the engaging member of the other panel, and sealing means being provided between said projection of one panel and the adjacent side edge portion of the corresponding facing sheet of the other panel.

The sealing means preferably comprises a tubular seal formed from resilient material, said tubular seal extending along the length of the joint, non-drying sealant provided between said projection and the adjacent face of the tubular seal, and further non-drying sealant provided between said side edge portion and the adjacent face of said tubular seal.

The invention will be better understood by reference to the following description of one specific embodiment thereof as shown in the accompanying drawing which is a schematic cross-sectional view of a joint according to the invention.

As shown in the drawing, the laminated panels 11 are composed of a core lamination 13 of expanded polystyrene insulation and facing sheet laminations 15 bonded by structural thermosetting adhesive to each side of the core 13 such that the panel behaves as a structural unit. At least one side edge portion of one facing sheet 15*a* of each panel is formed such that it extends beyond the core lamination 13 so as to define a projection 17. The opposed side edge portion 18 of the facing sheet 15*a* is provided with an engaging member 19 preferably spaced inwardly from the edge thereof. A pair of panels are intended to be butted together as shown in the accompanying drawing so that the projection 17 of one panel is engaged by the engaging member 19 of the adjacent connected panel. In the construction shown in the drawing the engaging member 19 is in the form of a plurality of holding tabs 21 spaced along the length of the side edge portion of the panel with which the engaging member is associated. Each holding tab is secured at its inner side to the panel by any suitable means such as rivetting. A seal 23 formed from resilient plastics material such as neoprene is fitted at the joint between each holding tab and the panel so as to ensure that the joint is waterproof. Each holding tab is provided at its outer side with an up-turned portion which defines a safety edge 25. The safety edge 25 is intended to prevent the holding tab from damaging the projection 17 of the adjacent panel whilst in engagement therewith.

A sealing means 27 is provided such that when the projection 17 of one panel is engaged by the engaging means of the other panel the sealing means is located in the region of overlap between the projection of said one panel and said adjacent side edge portion 18 of the other panel. Said sealing means 27 is intended to prevent the ingress of water or moisture laden vapour through said region of overlap into the region between the abutting panels. The sealing means 27 preferably comprises a tubular seal 31, formed from resilient material, extending the length of the joint. One or more beads 33 of non-drying mastic sealant are provided between the inner face of the projection 17 of said one panel and the adjacent face of the tubular seal. In addition, one or more beads 35 of non-drying mastic sealant are provided between the side edge portion 18 of said other panel and the adjacent face of the tubular seal. The beads of sealant 33 and 35 extend along the length of the tubular seal. The tubular seal 31 is capable of limited "rolling" movement substantially transverse to its longitudinal axis so as to accomodate relative movement between the projection 17 of one panel and the adjacent side edge portion 18 of the other panel without damage to the sealing means. The holding tabs 21 are adapted to bear on the projection 17 thus ensuring that said sealing means 27 remains intact. The outer end of the projection is preferably inclined inwardly to ensure ease of engagement with the engaging means.

The panels are installed such that any water on the facing sheet 15 of each panel runs over one of the projections 17 thereof onto an adjacent panel. The direction of water run-off is such that water flows over the projection 17 incorporated in the joint between adjacent panels and not into the region of overlap between the projection 17 of one panel and the side edge portion 18 of the other panel.

I claim:

1. A jointing construction for laminated panels of the type having a core lamination of heat insulating material and facing sheet laminations bonded to opposed sides of the core, the jointing construction being characterized in that one of said panels is formed with one side edge portion of one facing sheet extending beyond the core lamination to define a projection, the adjacent side edge portion of the facing sheet of the adjacent panel having an engaging member associated therewith, the engaging member having engaging means spaced from the respective facing sheet to define a gap therebetween, the pair of said panels in use being disposed adjacent each other with the projection of one panel engaged by the engaging member of the other panel and retained in said gap, and sealing means provided between said projection of said one panel and the adjacent side edge portion of the corresponding facing sheet of said adjacent panel, said sealing means comprising a tubular seal formed from resilient material, said tubular seal extending along the length of the joint, non-drying sealant provided between said projection and the adjacent side face of the tubular seal, and further non-drying sealant provided between said adjacent side edge portion and the adjacent face of said tubular seal.

2. A jointing construction as claimed in claim 1 wherein the sealant on each side of the tubular seal is in the form of one or more beads extending along the length of the joint.

3. A jointing construction for laminated panels of the type having a core lamination of heat insulating material and facing sheet laminations bonded to opposed sides of the core, the jointing construction being characterized in that one of said panels is formed with one side edge portion of one facing sheet extending beyond the core lamination to define a projection, the adjacent side edge portion of the facing sheet of the adjacent panel having an engaging member associated therewith, the engaging member having engaging means spaced from the respective facing sheet to define a gap therebetween, the pair of said panels in use being disposed adjacent each other with the projection of one panel engaged by the engaging member of the other panel and retained in said gap, and sealing means provided between said projection of said one panel and the adjacent side edge portion of the corresponding facing sheet of said adjacent panel wherein the engaging means is spaced inwardly from the side edge portion of the panel with which it is associated.

4. A jointing construction as claimed in claim 3 wherein said engaging means comprises a plurality of spaced holding tabs.

5. A jointing construction as claimed in claim 4 wherein each holding tab is secured at its inner end to the adjacent panel, a seal being provided at the junction between said tab and the adjacent panel, the outer end of the tab being provided with a out-turned safety edge.

6. A jointing construction as claimed in claim 3 wherein the outer end of said projection is turned inwardly.

* * * * *